United States Patent [19]

Johndrow et al.

[11] Patent Number: 4,771,913

[45] Date of Patent: Sep. 20, 1988

[54] OVEN FOR USE IN A VENDING MACHINE

[75] Inventors: John P. Johndrow, Stafford; Paul R. Taylor, Nottingham; Martin E. Wigg, Wolverhampton, all of United Kingdom; Harold M. Wright, deceased, late of Sutton Coldfield, England, by Julie K. Whatson, Sally-Anne Wright, administratrices

[73] Assignee: Sankey Vending Limited, West Midlands, England

[21] Appl. No.: 925,630

[22] PCT Filed: Feb. 10, 1986

[86] PCT No.: PCT/GB86/00069

§ 371 Date: Dec. 8, 1986

§ 102(e) Date: Dec. 8, 1986

[87] PCT Pub. No.: WO86/04706

PCT Pub. Date: Aug. 14, 1986

[30] Foreign Application Priority Data

Feb. 9, 1985 [GB] United Kingdom ..... 8503384
Jun. 15, 1985 [GB] United Kingdom ..... 8515236

[51] Int. Cl.[4] ..... A24F 27/14

[52] U.S. Cl. ..... 221/150 A; 99/355; 49/41

[58] Field of Search ..... 221/150 R, 150 HC, 150 A; 99/373, 357, 355; 49/41, 425

[56] References Cited

U.S. PATENT DOCUMENTS

| | | | |
|---|---|---|---|
| 2,950,024 | 8/1960 | Adler | 221/15 |
| 2,956,144 | 10/1960 | Woodman | 219/10.55 |
| 3,224,643 | 12/1965 | White | 221/150 R |
| 3,329,080 | 7/1967 | Reach | 221/150 HC |
| 3,534,676 | 10/1970 | Rubino | 99/355 |
| 3,620,341 | 12/1971 | Gardner | 221/110 |
| 3,653,541 | 4/1972 | Crum | 221/150 HC |
| 3,866,795 | 2/1975 | Urano | 221/150 HC |
| 4,482,078 | 11/1984 | Reiss | 221/150 HC |
| 4,671,425 | 6/1987 | Knoll | 221/150 HC |

FOREIGN PATENT DOCUMENTS 1161350 8/1961 United Kingdom .

*Primary Examiner*—Joseph J. Rolla
*Assistant Examiner*—Kenneth Noland
*Attorney, Agent, or Firm*—Marshall, O'Toole, Gerstein, Murray & Bicknell

[57] ABSTRACT

An oven comprises a housing provided with an aperture which is closable by a single movable element. A conveyor is disposed within the housing, the arrangement being such that when the aperture is open articles may enter the oven from above and may be discharged laterally by the conveyor.

9 Claims, 5 Drawing Sheets

OVEN FOR USE IN A VENDING MACHINE

This invention relates to an oven which may be used in a vending machine.

Apparatus for vending heated-on-demand precooked food has been proposed wherein upon insertion of a sum of money containers of food are automatically conveyed from a storage chamber into a heating chamber and then are delivered to a dispensing outlet. The storage chamber may be refrigerated and the heating chamber may be a microwave oven.

In one known type of such apparatus, e.g. that disclosed in French Patent Specification No. 2458851, a microwave oven is disposed below a food storage chamber. Upon activation of the machine a container slides down an inclined plane into the oven and, after heating, slides down a further inclined plane to the dispensing outlet.

A disadvantage of such apparatus is that a considerable proportion of the height of the apparatus above the dispensing outlet is occupied by the said incline planes thus reducing the space available for the storage chamber.

In another known type of apparatus, e.g. that disclosed in British Patent Specification No. 2134503, a microwave oven is disposed to the side of a storage chamber, the selected container being moved laterally from the storage chamber to the oven by a conveyor and then laterally from the oven to the dispensing location by a further conveyor.

This configuration allows a greater proportion of the machine height above the dispensing outlet to be used for the storage chamber, however such a machine must be considerably wider than a machine wherein the oven is disposed below the storage chamber.

The object of the present invention is to provide an oven for use in a vending machine which is more compact than the apparatus of the prior art.

According to the invention we provide an oven comprising a chamber provided with an aperture, a single movable closure element adapted to close said aperture, and conveying means such that when said aperture is open articles may enter the oven from above and may be discharged substantially horizontally from the oven by said conveying means.

Embodiments of the invention will now be described by way of example and with reference to the accompanying drawings in which.

Figure 1:
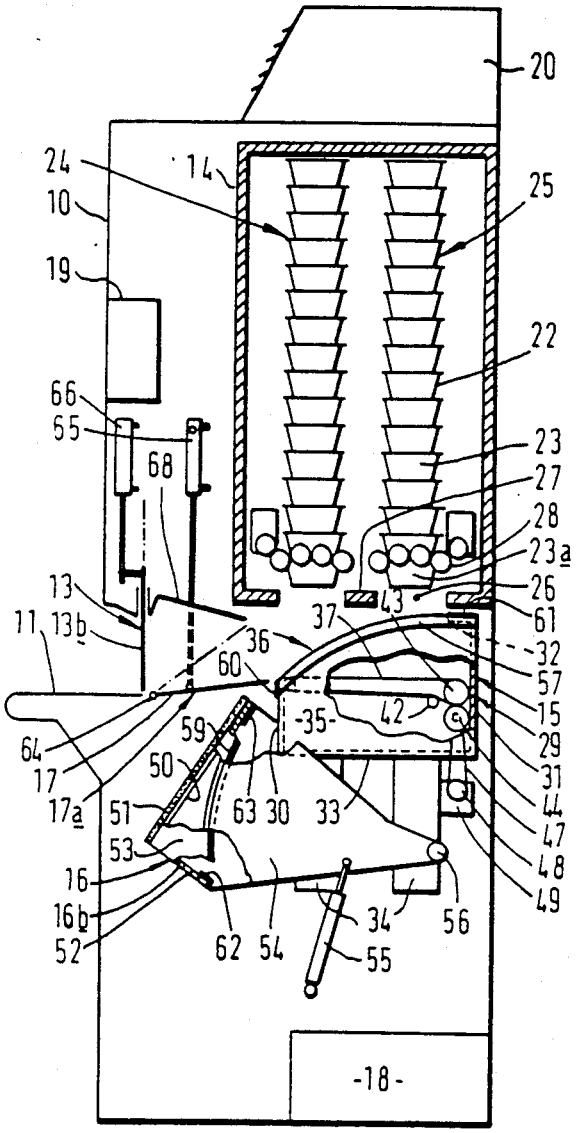
FIG. 1 is a schematic side elevational view of apparatus comprising a first embodiment of the invention.

The apparatus shown in FIGS. 1 to 4 comprises a metal cabinet shown generally as 10 having a shelf 11 projecting from its front face 12 and an upwardly slidable hatch 13 mounted above the shelf.

The cabinet 10 contains; an insulated storage chamber 14; a microwave oven shown generally as 15; a movable closure element 16; a movable delivery flap 17; a compressor 18; and coin freed control means 19 of known type.

The storage chamber 14 which is cooled by refrigerator 20 is mounted above the oven 15 and holds ten stacks 22 of flanged food containers 23 arranged in two ranks 24 and 25 of five stacks. The stacks 22 are supported above apertures 26 in the floor 27 of the storage chamber 14 by article release means 28 of any suitable type which is selectively operable to release the lowermost container **23*a* of any selected stack 22**.

The oven 15 comprises a housing 29 having a front wall 30; a back wall 31; an upper wall 32 and a lower wall 33.

Two magnetrons 34 are mounted below the lower wall 33. The housing has an aperture 36 which extends from the front edge of the upper wall 32 to the upper edge of the front wall 30 and is bounded by the upper arcuate edges of the side walls 35.

The oven aperture 36 underlies all of the storage chamber apertures 26 so that there is a direct vertical path for any container **23*a* released by the release means 28 down through the respective storage chamber aperture 26 and oven aperture 36** into the oven housing.

A conveyor 37 is provided within the oven housing 29 which is operable to discharge containers 23 laterally from the oven housing 29 through the oven aperture 36.

The conveyor 37 is releasably secured within the oven housing 29 and comprises an endless belt 38 (see FIG. 4) of flexiable material passing around a driving roller 39 and an assembly of rods 40 which are held in spaced parallel arrangement by side pieces 41. The belt 38 is held in tension around the driving roller 39 situated at the end of the conveyor 37 nearest to the back of the oven housing 29 by means of a spring-biased pinch-roller 42.

Power is transmitted to the driving roller 39 by means of a toothed wheel 43 mounted at the end thereof and driven by a second toothed wheel 44 mounted within the oven housing 29 on a shaft 45 which passes out through a side wall 35. The end of the shaft 45 outside the oven housing 29 carries a sprocket 46 which is driven by means of a toothed belt 47 from a sprocket 48 carried by an electric motor 49. The arrangement is such that when the conveyor 37 is lifted out of the oven 15 for cleaning, the toothed wheels 43, 44 disengage and, when the conveyor 37 is replaced, the toothed wheels 43, 44 engage so that no separate operation is required to disconnect the conveyor 37 from its source of power.

The movable closure element 16 comprises: an upper wall 50 provided with a resilient foam pad 51, a front wall 52, a pair of side walls 53 and side support members 54. The element is movable by a linear pneumatic actuator 55 between a closed position **16*a* shown in FIG. 2, wherein the oven 15 is closed and sealed against the egress of microwave radiation and wherein the resilient foam pad 56 prevents the escape of cooled air from the storage chamber 14, and an open position 16*b* shown in FIG. 1 wherein the oven and storage chamber apertures 36, 26** are open.

The closure element 16 is pivotable about a horizontal pivot axis 56 which passes through the side support members 54 below the oven.

The upper edges of oven housing side walls 35 and the lower edges of the closure element side walls 53 are arcuate about the pivot axis 56. Guide members 57 of channel section (see FIG. 3) which are open towards the top are secured to the outer faces of the oven housing side walls 35 adjacent to the upper edges thereof and have the same curvature. The arrangement is such that when the closure element 16 is in its closed position 16*a* the lowermost edges of the closure element sidewalls 53 and the wall portions adjacent thereto are enclosed by the guide members 57. Seals 58, 59 of plastics material which is opaque to microwave radiation are provided within the channels of the guide members and on the faces of the closure element side walls which are enclosed by the guide members. Simialr seals 60, 61 are provided on the outside of the front and upper walls 30, 32 of the oven housing 29 which abut with seals 62, 63 on the inside of the front and upper walls 52, 50 of the closure element 16.

The complementary sealing surfaces of the guide members and closure element side walls are not intended to be in contact but are separated by a gap of small dimension with respect to the wavelength of the microwaves employed. Thus the complementary sealing surfaces constitute labyrinth choke formations which prevent the egress of microwave radiation when the oven 15 is in operation.

Figure 2:
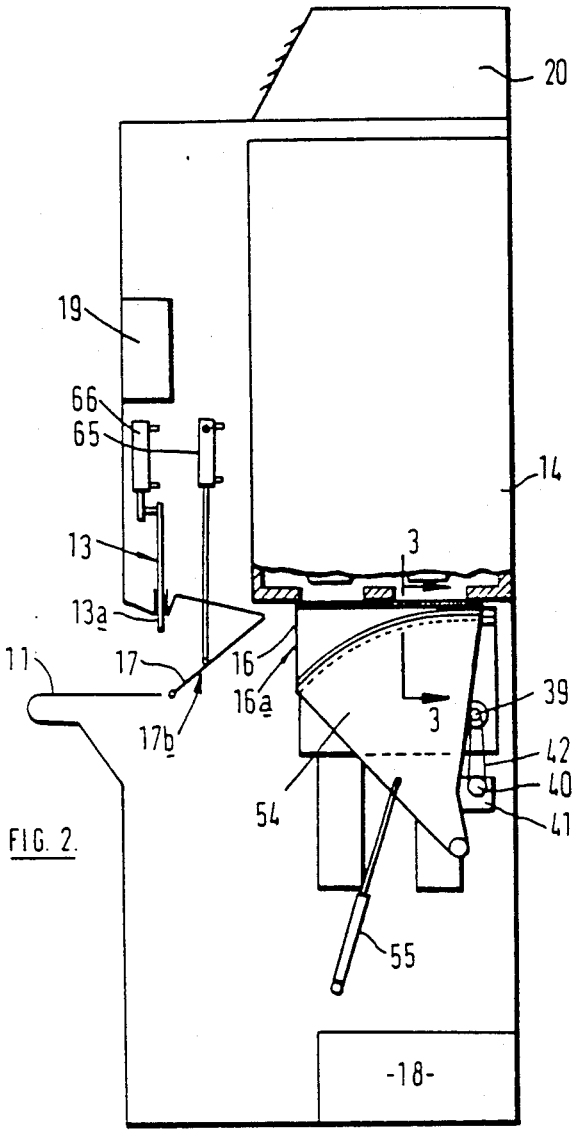
FIG. 2 is a schematic side elevational view of the apparatus of FIG. 1 showing certain movable elements of the apparatus disposed in different positions to those shown in FIG. 1.
Figure 3:
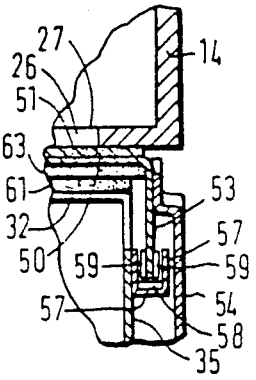
FIG. 3 is a section front view on the line 3—3 of FIG. 2.
Figure 4:
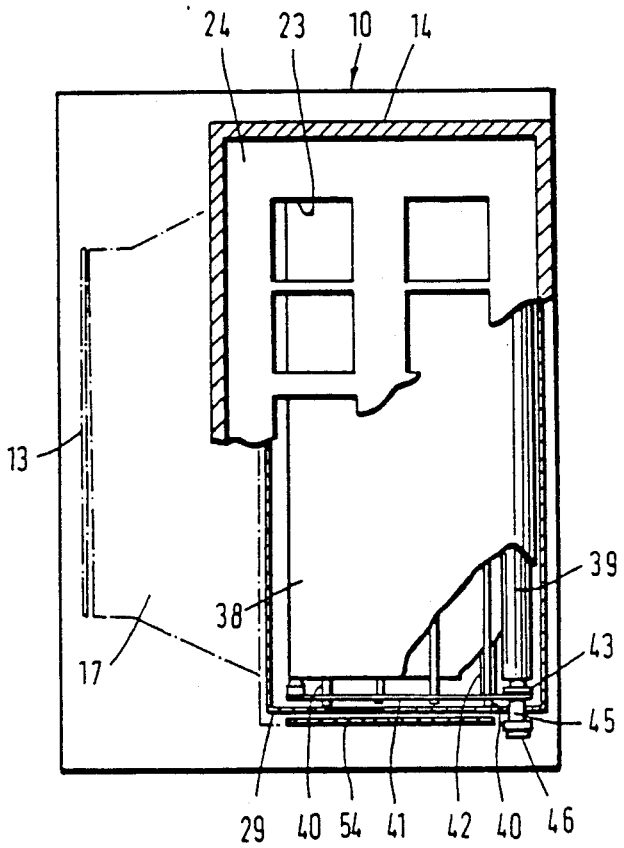
FIG. 4 is a schematic plan view of the apparatus of FIGS. 1 and 2 broken away to illustrate details of its construction.

The delivery flap 17 is pivotable about an axis 64 adjacent to the hatch 13 by an actuator 65 between a receiving position 17*a* shown in FIG. 1 wherein the flap is disposed approximately horizontally, one edge being adjacent to the oven aperture 36, and a delivery position 17b shown in FIG. 2 wherein the flap is disposed at an angle of approximately 45 degrees to the horizontal.

The operation of the machine is as follows: after the customer has deposited the required sum of money and made his or her selection from the ten stacks 22, the control means 19 initiates the following sequence of operations: the closure element 16 which is normally in its closed position 16*a* as shown in FIG. 2 is moved by the actuator 55 to its open position 16*b* as shown in FIG. 1. The selected container 23 is released by the article release means 28 such that it falls vertically from its stack 22 in the storage chamber 14 through the respective storage chamber aperture 26 then falls through the oven aperture 36 into the oven housing 29 to come to rest on the conveyor 37.

If the selected container is from the front rank 24 of stcks 22 then it lands of the part of the conveyor 37 nearest to the front of the oven housing 29 and the conveyor 37 then operates to carry it to the rear part of the oven housing 29 to prevent it fouling the movement of the closure element 16.

If the container is from the rear rank 25 of stacks 22 then it will come to rest in the rear part of the oven housing 29 and the conveyor 37 is not operated.

The actuator 55 then moves the closure element 16 to its closed position 16*a* and the magnetrons 34 are energised for a suitable period of time, for example 30 seconds, so that the food within the container is heated. After the magnetrons 34 are switched off the closure element 16 is moved to its open position 16*b* by the actuator 55. The delivery flap 17 is then lowered to its receiving position 17*a* shown in FIG. 1 by an actuator 65 and the conveyor 37 operates to discharge the container laterally from the front of the oven housing 29 through the oven aperture 36 onto the delivery flap 17. The delivery flap 17 is then raised to its delivery positon 17*b* shown in FIG. 2 so that the container slides down the flap 17 until it contacts the hatch 13. With the delivery flap 17 in its delivery position 17*b* the closure element 16 is returned to its closed position 16*a* and the hatch 13 is then raised by an actuator 66 to its open position 13*a* shown in FIG. 2 so that the container slides down the inclined delivery flap 17 onto the shelf 11 where it may be received by the customer. The hatch 13 is then lowered to its closed position 13*b* shown in FIG. 1.

When the hatch 13 is open the raised delivery flap 17 cooperates with a panel 68 to prevent unauthorised access to interior parts of the apparatus. The delivery flap 17 must be in its raised position for the closure element 16 to be able to move between its two positions.

Actuators 55, 65 and 66 are motivated by means of compressed air supplied by the compressor 18.

Figure 5:
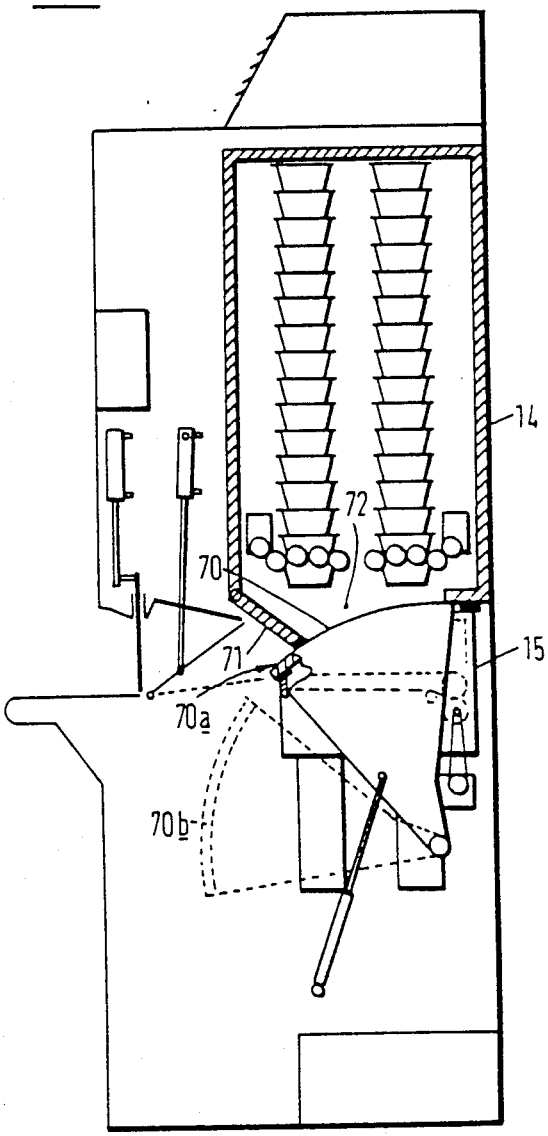
FIG. 5 is a schematic side elevational view of a second embodiment of the invention.
Figure 6:
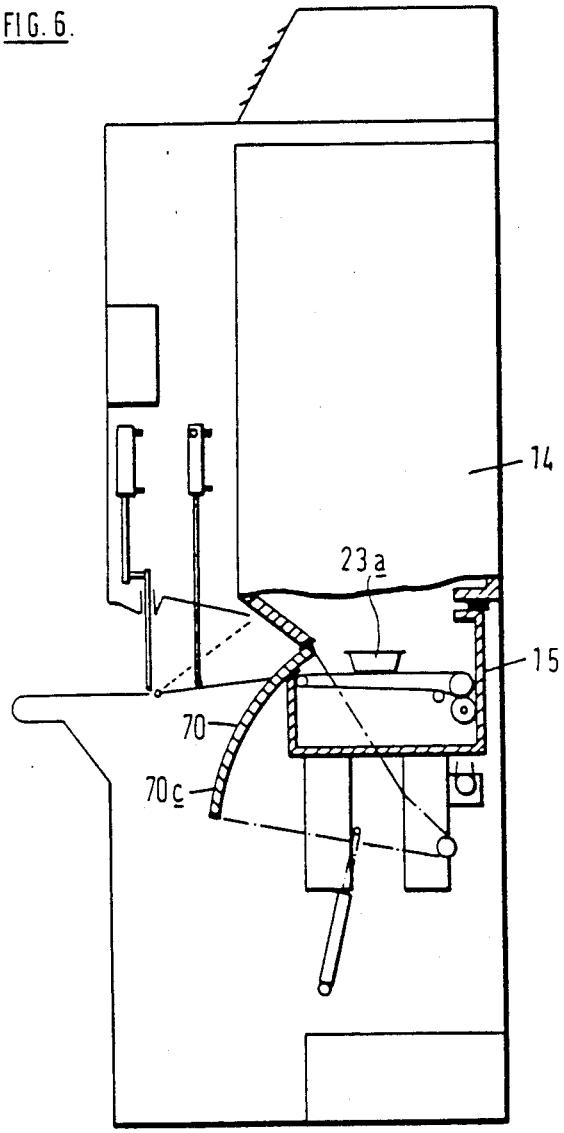
FIG. 6 is a schematic side elevational view of the apparatus shown in FIG. 4 showing a movable element in a different position.

The embodiment shown in FIGS. 5 and 6 has a slightly different oven and storage chamber closure arrangement to that shown in the other figures.

The oven 15 is disposed beneath the storage chamber 14 as in the first embodiment of the invention.

The closure element 70 is shaped as part of the curved surface of a cylinder and is movable between a closed position shown generally as 70*a* wherein the oven 15 is closed and sealed the egress of microwave radiation as in the previous embodiment and the storage chamber 14 is sealed against loss of cooled air by the closure element 70 cooperating with an inclined depending wall 71 of the storage chamber 14 and an open position shown generally as 70*b* wherein the oven 15 and storage chamber 14 are open as in the first embodiment. Only one large aperture 72 is provided in the floor of the storage chamber 14. The closure element 70 may also be disposed in an intermediate position shown generally as 70*c* in FIG. 4 wherein the oven 15 and storage chamber 14 together form a closed chamber so that containers 20 can be delivered from the storage chamber 14 to the oven 15 without escape of cooled air.

This embodiment also has the advantage that the delivery flap 17 need not be raised during the movement of the closure element 70 because the closure element 70 is thin enough to pass through the gap between the front wall 30 of the oven housing 29 and the back edge of the lowered delivery flap 17.

Various modifications maybe made within the scope of the invention for example:

the closure element could be moved by means of a motor turning a pinion engaging a rack formation arcuate about the pivot axis and mounted on a closure element side wall. Instead of the complementary sealing surfaces of the closure elemente side walls and guide members being separated by a constant small gap they could be arranged such that when the closure element is moved towards its closed position the gap between said surfaces decreases until they contact. This could be achieved for example by making said surfaces arcuate about an axis parallel to but spaced a small distance from the pivot axis or they could have a non-arcuate curvature.

We claim:

1. An oven comprising a housing provided with a single aperture for both receiving and discharging articles to be heated; a single closure element pivotable about a pivot axis between an open position, wherein articles may enter the oven from above through said aperture and may be discharged from the oven substantially horizontally through said aperture, and a closed position wherein said aperture is closed; and conveying means located wholly within said housing for discharging an article through said aperture when the closure element is in its open position, the aperture and the closure element having wall portion edges which are mutually adjacent when said closure element is in its closed position and which are respectively convex and concave when considered in a plane perpendicular to said pivot axis.

2. An oven according to claim 1 wherein said edges are arcuate about said pivot axis.

3. An oven according to claim 1 wherein said edges are arcuate about an axis parallel to but offset from said pivot axis.

4. An oven according to claim 1 wherein said conveying means comprises a belt conveyor removable from the chamber as a unit, a driven formation of the conveyor being engageably with driving means within the oven.

5. An oven according to claim 1 wherein said conveying means is also operable to convey articles within the housing in a direction opposite to that in which articles are discharged.

6. An oven according to claim 1 wherein said wall portion edges are provided with inter-engaging formations which co-operate to provide labyrinth passages which prevent the egress of microwave energy when the housing aperture is closed.

7. An oven according to claim 1 wherein said closure element is shaped as part of the curved surface of a cylinder.

8. An oven according to claim 1 wherein said chamber and said closure element when the latter is in its closed position together form a substantially parallelepipedal enclosure.

9. A vending machine comprising an oven as claimed in claim 1.

* * * * *